US005823336A

United States Patent [19]

Smith

[11] Patent Number: 5,823,336

[45] Date of Patent: Oct. 20, 1998

[54] GOLF BAG WITH CLUB SEPARATOR

[76] Inventor: Benny E. Smith, 327 Buttonwood Dr., Sebring, Fla. 33872

[21] Appl. No.: 925,236

[22] Filed: Sep. 8, 1997

Related U.S. Application Data

[63] Continuation-in-part of Ser. No. 763,288, Dec. 11, 1996, abandoned.

[51] Int. Cl.[6] ..... A63B 55/00

[52] U.S. Cl. ..... 206/315.6; 206/315.3

[58] Field of Search ..... 206/315.2, 315.3, 206/315.6

[56] References Cited

U.S. PATENT DOCUMENTS

| | | | |
|---|---|---|---|
| 936,698 | 10/1909 | Breakspear | 206/315.6 |
| 1,434,621 | 11/1922 | Marwood et al. | 206/315.6 |
| 2,551,780 | 5/1951 | Wood | 206/315.6 X |
| 3,460,597 | 8/1969 | Daly | 206/315.6 X |
| 3,503,518 | 3/1970 | Black | 206/315.6 X |
| 3,534,795 | 10/1970 | Wiedenmeier | 206/315.6 |
| 4,130,153 | 12/1978 | Zopf | 206/315.6 |
| 4,136,724 | 1/1979 | Leitzel | 206/315.6 |
| 4,194,547 | 3/1980 | Sidor et al. | 206/315.6 |
| 4,282,912 | 8/1981 | Brown | 206/315.6 X |
| 4,836,565 | 6/1989 | Catalo | 206/315.2 X |
| 5,168,992 | 12/1992 | Bowdy | 206/315.6 |
| 5,607,053 | 3/1997 | Sumiyoshi | 206/315.2 |
| 5,699,906 | 12/1997 | Lombardo et al. | 206/315.3 |

*Primary Examiner*—Sue A. Weaver
*Attorney, Agent, or Firm*—Charles J. Prescott

[57] ABSTRACT

A golf bag for carrying a set of golf clubs including woods, irons and putter with the heads of the woods and putter positioned upward and the heads of the irons positioned downward. The golf bag includes a conventional tubular body capped at its upper end by a throat plate that includes a plurality of somewhat oval shaped first openings having individually shaped peripheries sized to admit the head of only one particular iron and a plurality of second openings to admit the shafts of the woods and putter. The bag has a bottom plate that supports guide members equal in number to the plurality of first throat openings, each guide member serving to individually retain the head of one iron of the club set resting on the bottom plate. The golf bag improves weight distribution of the bag contents, keeps individual irons from coming into contact with one another, stops them from rattling, organizes them so as to make them easy to locate and mitigates damage to shafts of clubs made with graphite shafts.

7 Claims, 4 Drawing Sheets

GOLF BAG WITH CLUB SEPARATOR

This application is a continuation-in-part of U.S. patent application Ser. No. 08/763,288, filed Dec. 11, 1996, now abandoned.

BACKGROUND OF THE INVENTION

1. Scope of Invention

This application relates to golf bags of improved design. More particularly, it concerns golf bags that have unique features including carriage of irons with heads down, improved distribution of club weight and protection of club shafts.

2. Prior Art

Golf bags are manufactured and offered for sale in a multitude of forms from the light weight, subset cloth bags (See U.S. Pat. No. 5,238,109) to the heavy weight, multi-compartment bags (See U.S. Pat. No. 5,222,598).

Many innovations have been applied in design and construction of golf bags to mitigate problems with prior construction or provide special features. For example, one type innovation concerns protection of the heads of wood clubs (See U.S. Pat. No. 1,876,134 & 5,004,345).

While the majority of golf bags carry a full set of clubs loosely and unseparated, another type innovation concerns separating clubs individually or ill groups by providing longitudinal separators therein (See U.S. Pat. No. 4,311,178, 5,148,915, 5,135,107, 5,279,414, 5,465,839 & 5,544,743).

A further type innovation concerns modification of the top portion or throat of the golf bags to hold club heads individually separated or separated in small groups (See U.S. Pat. No. 4,596,328, 4,600,100, 4,667,820, 4,995,510 & 5,458,240).

Yet another type Innovation to separate and organize clubs involves providing a special type throat on the bag plus contoured seats or recesses in the bottom of the bag (See U.S. Pat. No. 5,029,703).

Still another type innovation to separate and organize clubs involves providing grouped ledges and brackets upstanding from the bag throat (See U.S. Pat. No. 3,503, 518).

All of the innovations discussed above relate to conventional golf bags into which clubs are inserted, shaft first, with heads up. It has also been disclosed to carry the irons of a golf club set with heads down in an unconventional, rectangular case (See U.S. Pat. No. 5,168,992).

In addition to club organization problems associated with golf bags, the development of graphite shaft clubs has created yet another problem in carrying golf clubs in even improved type golf bags, i.e., damage to the graphite shafts by "nicking" (See U.S. Pat. No. 5,393,581).

A golf club carrier invented by Leitzel described in U.S. Pat. No. 4,136,724 teaches a pleated, resilient plastic irons separator for insertion of the irons clubs between adjacent folds into an upright orientation with club heads down. Although club separation is accomplished, any iron will fit between any of the pleats so that club identification is lacking.

Lastly, a very recent U.S. Pat. No. 5,607,053 teaches a golf club storing device invented by Sumiyoshi which stores all of the golf clubs, irons and woods, in the heads down position into elongated flexible tubular sacks. Again, no club identification is afforded by this device.

In spite of the numerous innovations that have been made and applied to golf bags, the vast majority of known golf bags continue to present users with problems, e.g., the top-heavy nature of the bags because the heaviest part of the clubs, namely the heads, are carried at the top of the bags, club damage and ease of identification. The present invention addresses these existing problems and others by providing golfers with an unconventional and remarkably improved type of golf bag.

A principal object of the invention therefore is the provision of golf bags of a unique, improved design.

It is therefore an object of this invention to keep individual irons from coming into contact with one another, to stop them from rattling and to organize them so as to make them easy to locate.

It is another object of this invention to mitigate damage to shafts of clubs made with graphite shafts.

A further object of this invention is to provide adequate space for the head of the putter so it will not touch other clubs even if the putters have a wide variation of sizes and shapes.

It is yet another object of this invention to accommodate a large range in shapes and sizes of woods or drivers carried in a set of clubs and to hold their heads in generally fixed position.

It is yet another object of this invention to carry all irons with heads down at the bottom of the improved golf bag thereby improving weight distribution in the golf bag and mitigating tendency to tip over.

Yet another object of this invention is to enable the new golf bags of the invention to have a size and elongated shape typical of conventional golf bags.

It is still another object of this invention to have the space tolerance to accept and hold all irons of most commercially available golf club sets.

Further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of an improved golf bag for carrying a set of golf clubs including woods, irons and putter with the heads of the woods and putter positioned upward and the heads of the irons positioned downward.

The improved golf bag includes a conventional type substantially tubular body elongated along a longitudinal axis with an upper portion having a upper end, a lower portion having a lower end and an integral central portion. It is characterized, in part, by a unique top section that caps the upper end and a unique bottom section that closes the lower end.

The unique top section comprises a throat member and preferably, a wall member. The throat member includes a throat plate defined by a first periphery and positioned substantially normal to the longitudinal axis of the bag with the first periphery connected to the upper portion. The wall member, which is preferably arcuate and upswept from the throat plate, is defined by a bottom portion and an integral top portion with such bottom portion projecting axially from and above the first periphery.

The throat plate contains X number of first openings axially therethrough having sized somewhat oval peripheries each for admitting only the head of a particular sized iron, and Y number of second openings axially therethrough sized to admit the shafts of the woods and putter. Advantageously, X is a number from 8 to 10 and Y is a number from 2 to 4.

There is a bottom plate defined by a second periphery and positioned normal to the longitudinal axis and the lower end of the lower portion of the tubular body is connected to such second periphery.

Guide members, X in number and each defined by a top end and a bottom end, are supported at the bottom end and spaced apart upon the bottom plate. Each guide member defines a guide periphery that mimics at least in part the sized peripheries of the first openings of the throat plate. In one embodiment, each of the guide members consists of a elongated, vertically positioned tube with the top end thereof attached to one of the oval peripheries of the throat plate.

In the preferred embodiment, each guide member comprises an opposed pair of U-shaped vertically positioned channel members, one of the channel members of each opposed pair serving to receive the toe of one of the irons of the set of clubs and the other of the each opposed pair of the channel members serving to receive the heel of such iron club. These guide members may extend part way or preferably all the way from the bottom plate to the throat plate, each guide member being connected to one of the oval peripheries.

The new golf bags of the invention eliminate several of the annoyances associated with the use of conventional golf bags, i.e., rattling of the clubs and haphazard, moveable carriage of clubs making them hard to quickly identify and be easily removable from the conventional bags. Thus, in the new golf bags, all clubs are held in an steady manner and organized position, particularly the irons which are held with shafts up and adjacent to the bag perimeter making each iron club easy to quickly identify and easily remove without interference from other clubs in the bag.

BRIEF DESCRIPTION OF THE DRAWINGS

A more complete understanding of the invention can be obtained by reference to the accompanying drawings in which generic parts of the illustrated matter are indicated by arrowhead lines associated with the designation numerals while specific parts are indicated with plain lines associated with the numerals and wherein.

DESCRIPTION OF THE PREFERRED EMBODIMENTS

Figure 1:
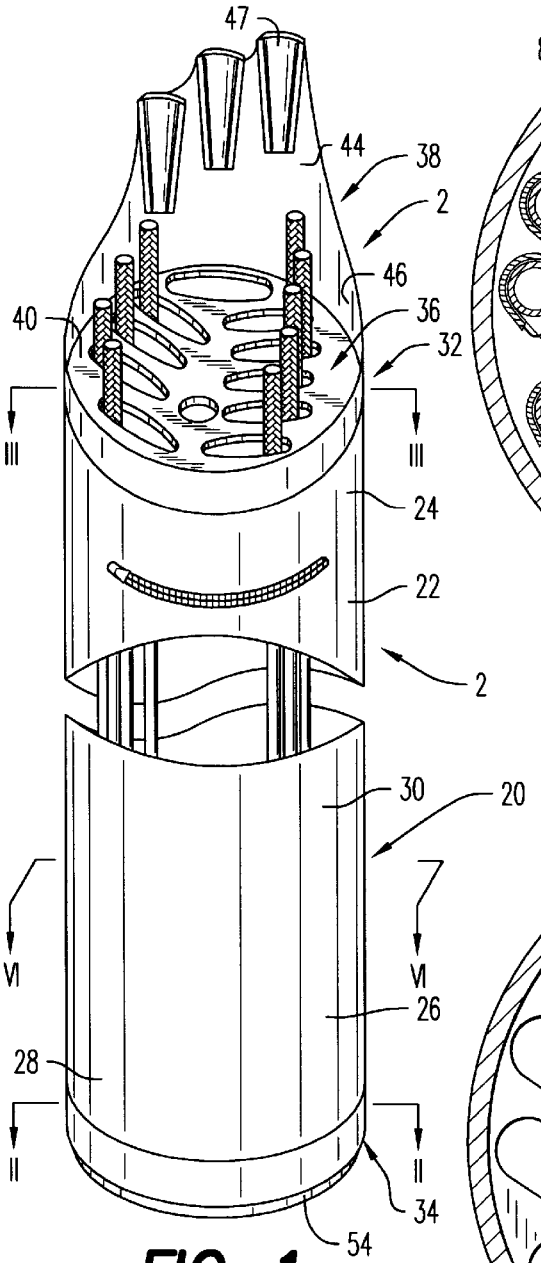
FIG. 1 is a fragmentary isometric view of one embodiment of a golf bag configured in accordance with the invention and holding the irons of a set of golf clubs.
Figure 2:
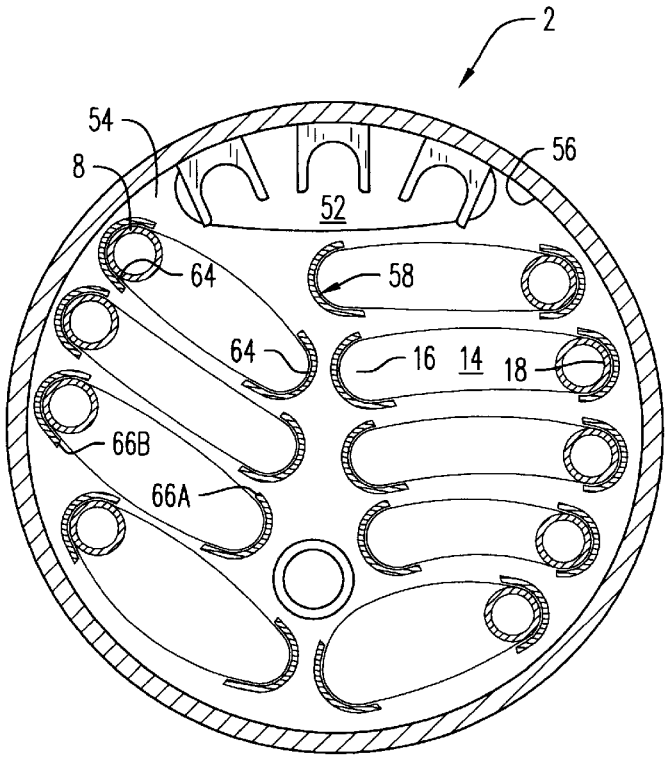
FIG. 2 is sectional plan view taken on the line II—II of FIG. 1.
Figure 3:
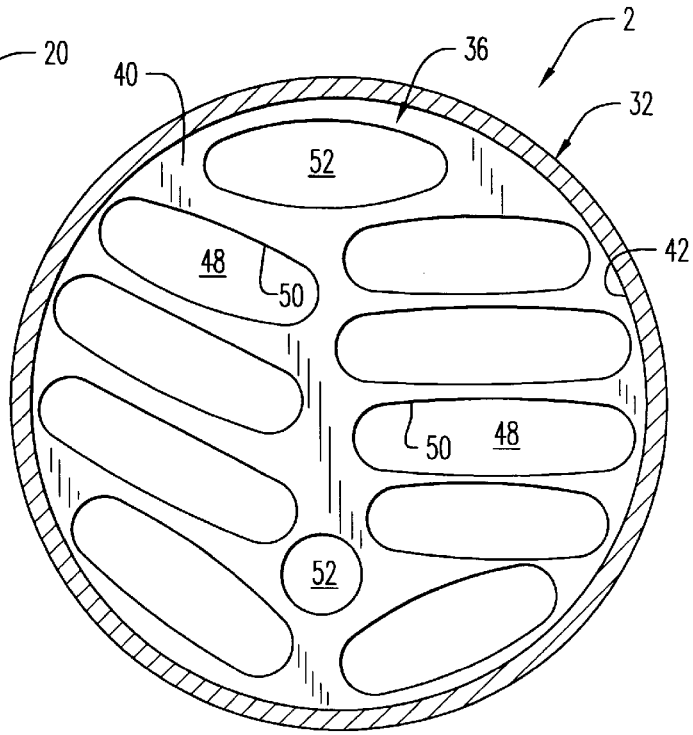
FIG. 3 is sectional plan view taken on the line III—III of FIG. 1.

A golf bag 2 is constructed in accordance with the invention for carrying a set of golf clubs 4 including woods 6, Irons 8 and putter 10, each having a shaft 12 and a head 14 with a toe 16 and a heel 18. The heads 14 of the woods 6 and putter 10 are positioned upward (see FIG. 4) and the heads of the irons are positioned downward to rest at the base of the bag 2.

The golf bag 2 includes a tubular body 20 elongated along a longitudinal axis and defined by an upper portion 22 having a upper end 24, a lower portion 26 having a lower end 28 and an integral central portion 30 which may be of a flexible, conventional nature.

There is a also a top section 32 capping the upper end 24 and a bottom section 34 closing the lower end 28. The top section 32 comprises a throat member 36 and a wall member 38. The throat member 36 includes a throat plate 40 defined by a periphery 42 connected to the upper end 24.

Figure 7:
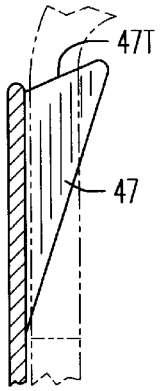
FIG. 7 is a fragmented, lateral sectional view of a wood club hanger member for the new golf clubs of the invention.

The wall member 38, which upsweeps from the throat plate 40, has a top portion 44 and bottom portion 46 that projects longitudinally from and above the periphery 42. The top portion 44 carries a plurality of hanger members 47 to support the heads 14 and shafts 12 of woods clubs 6. The unique manner of retention of woods clubs 6 in the bag 2 is illustrated in FIG. 7. There is no "clipping" action involved since such clips quickly wear out or otherwise become inoperative and may scuff or abrade the clubs. Instead, gravity serves to retain the woods clubs in position since the head 14 of the wood club 6 (shown in phantom) rests on the upperwardly angled top edge 47T of the hanger member 47.

The throat plate 40 contains a plurality of openings 48 axially therethrough having sized generally oval shaped peripheries 50 to admit the heads of the irons 8, and plurality of openings 52 axially therethrough sized to admit the shafts of the woods 6 and putter 10.

Figure 6:
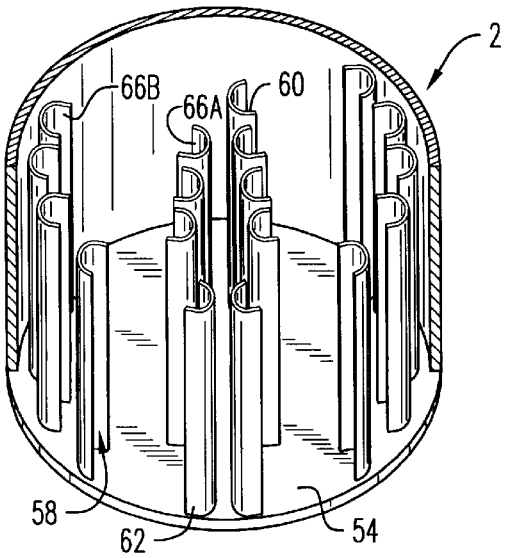
FIG. 6 is a downward angled, sectional isometric view taken on the line VI—VI of FIG. 1 with the golf clubs removed.

As seen in FIG. 6, there is a bottom plate 54 defined by a periphery 56 and to which the lower end 28 of lower portion 26 is connected. A plurality of guide members 58 each having a top end 60 and a bottom end 62 are supported on the bottom plate 54. Each guide member 58 defines a guide periphery 64 that mimics, at least in part, the peripheries 50 of openings 48 of the throat plate 40.

In the embodiment 2 of FIG. 1, each guide member 58 includes an opposed pair of U-shaped vertically positioned channel members 66A & 66B, members 66A serving to receive the toe 16 of one head 14 of the irons 8 of the set of clubs 4 and members 66B each serving to receive the heel 18 of one of the irons 8. In this embodiment 2, the number of guide members 58 are nine to accommodate a standard set of irons consisting of irons 3 to 9, a pitching wedge (P.W.) and a sand wedge (S.W.). In the embodiment of the bag 2A of FIG. 4, the number of guide members 58A are ten in number to accommodate a standard set of irons plus another irons club of choice (not shown).

Figure 8:
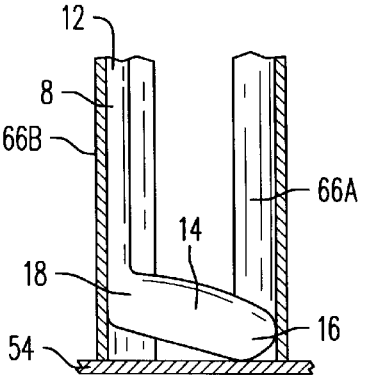
FIG. 8 is a diagrammatic lateral sectional view of the manner in which iron club heads are held in the new golf bags.

In use of the golf bag 2, the heads 14 of the irons 8 are inserted through the openings 48 and lowered into a respective guide member 58 so the toe 16 is enclosed by the channel member 66A and the heel 18 is enclosed by the channel member 66B. This guide member arrangement in the new bag 2 of the invention not only serves to keep each iron club 8 isolated from other clubs, but also serves to retain such club once it has been placed in the bag 2 without need to use clips or other retaining devices. This is illustrated in FIG. 8 where the toe 16 of iron club 8 rests against the channel member 66A and the bottom plate 54 while the heel 18 and shaft 12 are held elevated above the bottom plate 54 by the guide member 66B. Gravity thereby serves to hold the club 8 steady with the shaft 12 vertical and facing or leaning outwardly against the outside of the bag 2.

Figure 4:
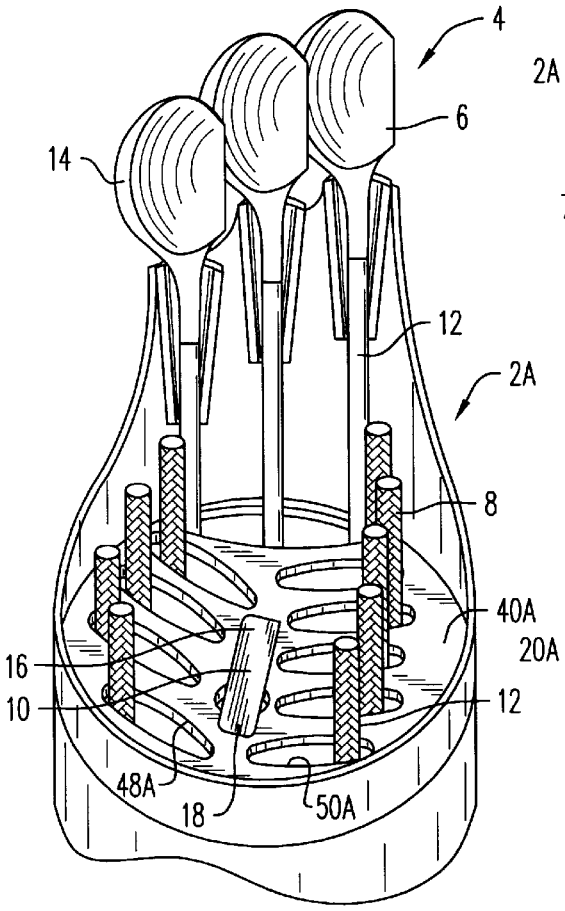
FIG. 4 is fragmentary isometric view of the upper portion of another embodiment of a golf bag configured in accordance with the invention and holding the woods, irons and putter of a set of golf clubs.
Figure 5:
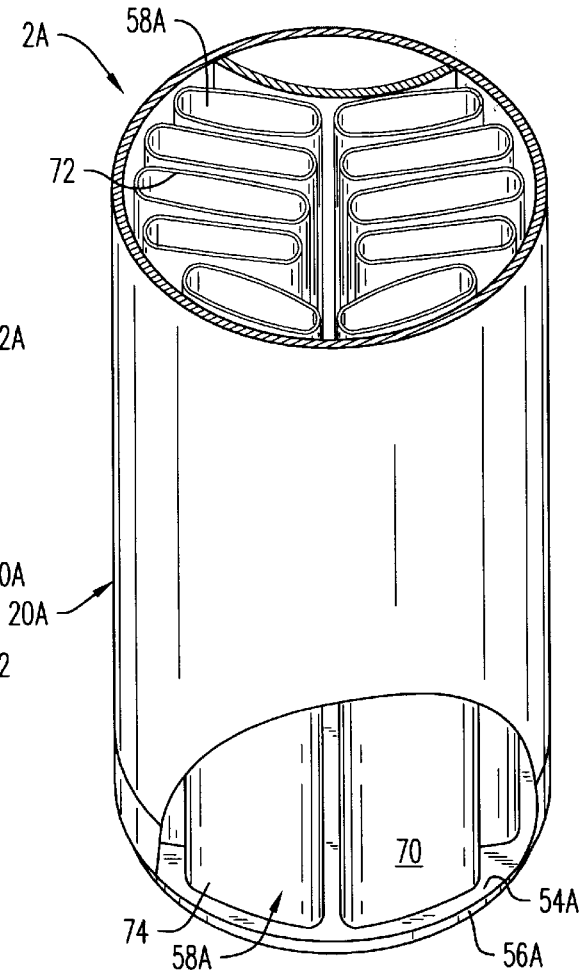
FIG. 5 is partially fragmented, sectional view of the lower portion of the golf bag shown in FIG. 4.

The improved golf bag 2A of FIG. 4, which includes a tubular body 20A, differs from golf bag 2 mainly in the form of the guide members 58A which are in the form of an elongated, vertically positioned tubes 70 as best seen in FIG. 5 with their top ends 72 attached to the oval peripheries 50A of the openings 48A of the throat plate 40A and their bottom ends 74 fixed in position on the bottom plate 54A connected and defined by its periphery 56A to the lower end of tubular body 20A.

The use of the golf bag 2A is similar to golf bag 2 although somewhat easier since the full tubular form of the guide members 58A automatically insures correct bottom positioning of the club heads 14 of all irons inserted into the bag 2A. In either embodiment 2 or 2A, the individual irons 8 are kept from coming into contact with one another and are prevented from rattling by gravity action as illustrated in FIG. 8. Also, since a separate "slot" is provided for each irons club 8, they are organized making them easy to locate or alerting the golfer to a missing club, and there being space and provision to hold all the irons of most commercially available golf club sets.

Further, the separate slot arrangement mitigates the possibility of damage to shafts of clubs made with graphite shafts and, since all irons are carried with heads down at the bottom of the golf bag, weight distribution also being improved (lowered) in the golf bag thereby mitigating the tendency of the bag to tip over. Moreover, the new golf bags provide adequate space for the head of the putter so it will not touch other clubs and they accommodate a large range in shapes and sizes of preferably sets of three woods carried in a set of golf clubs with their heads in generally fixed position. Additionally, the new golf bags of the invention can be made in the a tubular shape and size, e.g., about 9 inch diameter, of conventional golf bags so they can be carried paired in standard racks of golf carts.

Figure 9:
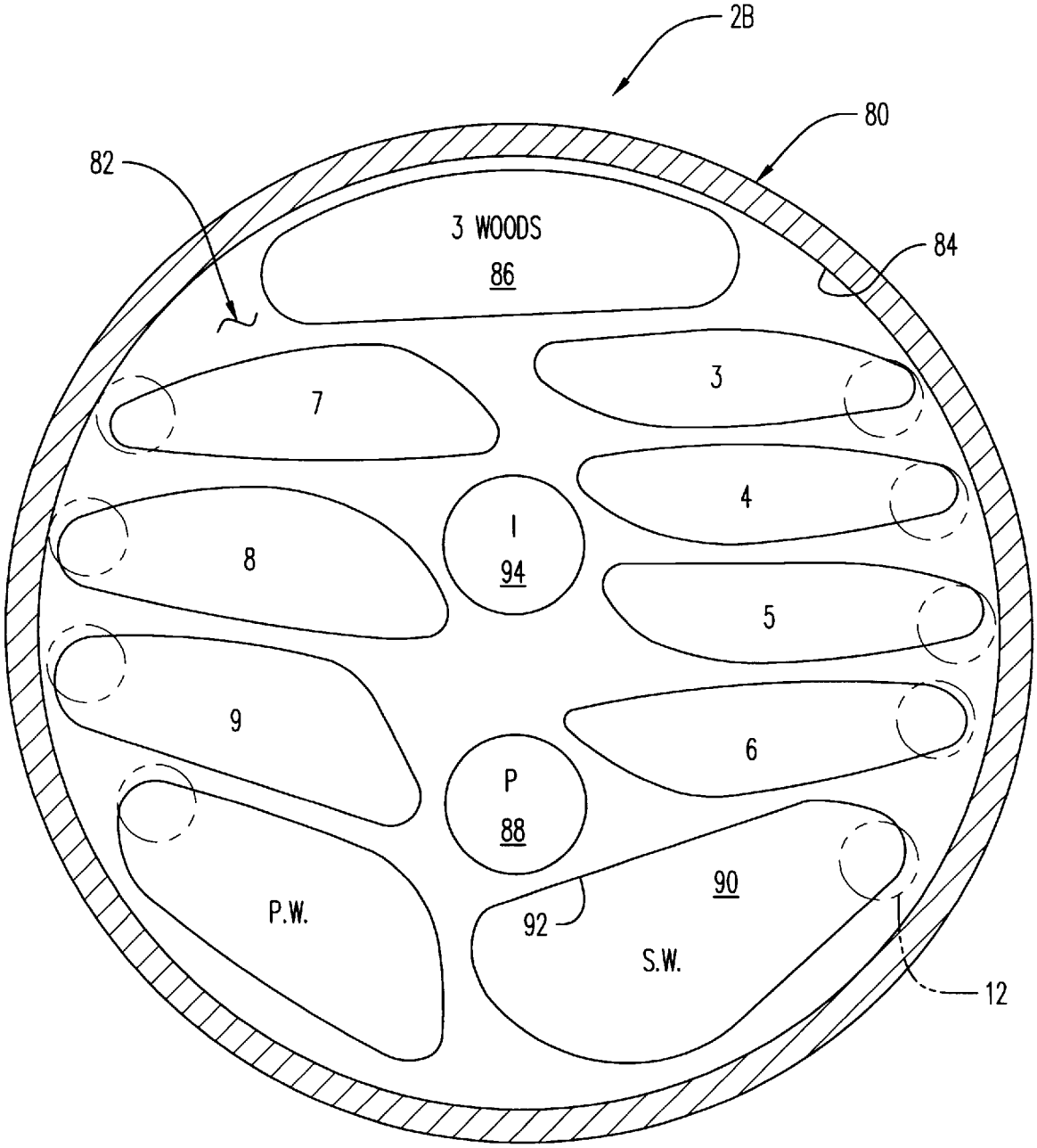
FIG. 9 is a top plan section view taken just above the throat plate (82) of another embodiment of the invention and looking downward therefrom.
Figure 10:
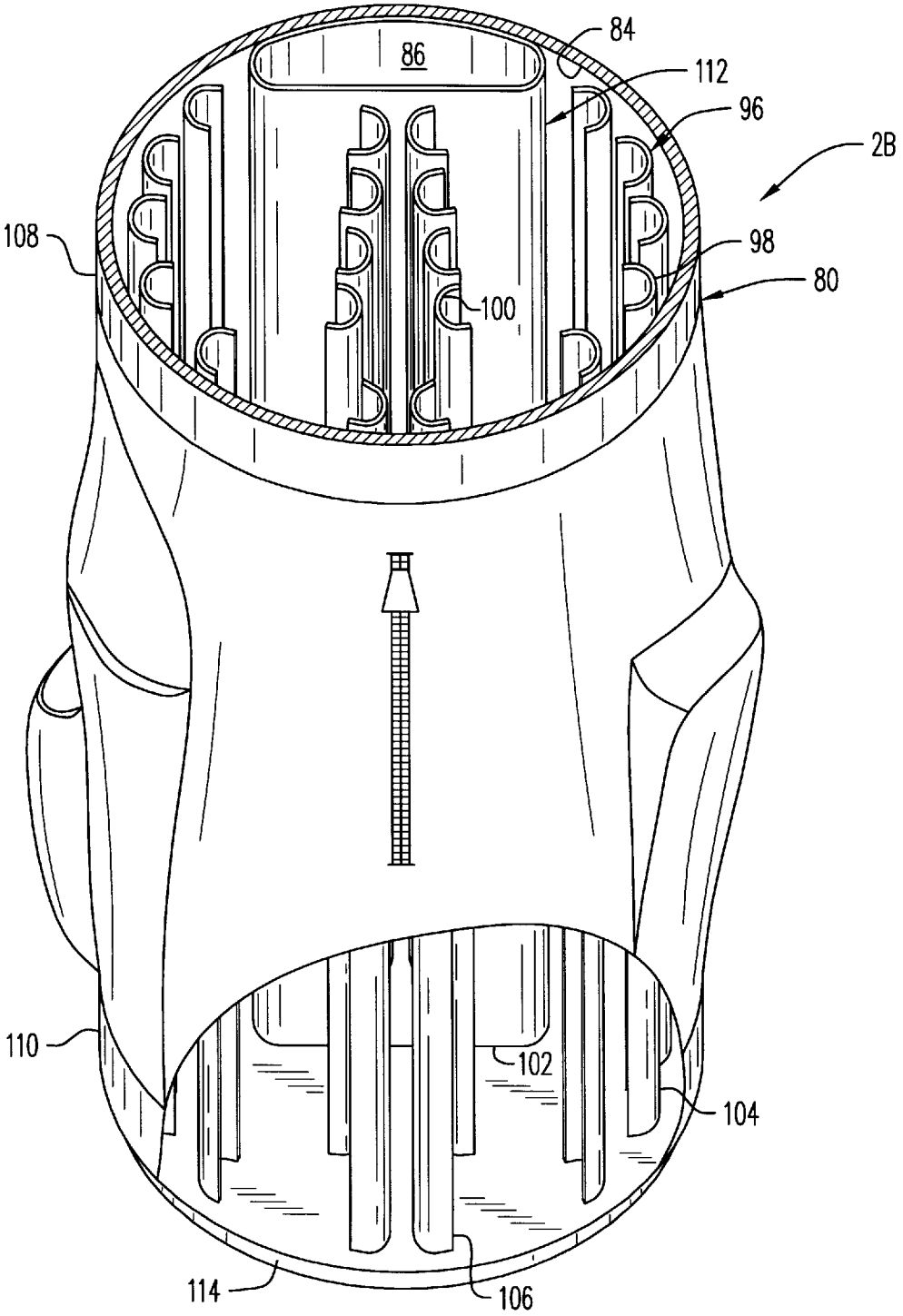
FIG. 10 is a partially fragmented section view of the lower portion of the golf bag shown in FIG. 9.

Referring lastly to FIGS. 9 and 10, another and preferred embodiment of the invention is shown generally at numeral 2B and includes a flexible generally tubular body 80 having rigid or semi-rigid upper and lower sections 108 and 110, respectively. The upper end of the top portion 108 is not shown and is similar to that of FIG. 1 at numeral 38.

A molded plastic throat member 82 in FIG. 9 is generally horizontally or transversely connected across the upper section 108 within periphery 84. This throat plate 82 includes a plurality of openings shown typically at 90 formed axially therethrough each having particularly configured profiles 92 as shown in FIG. 9. Rather than being generally oval shaped and similar as previously described, each of these openings 90 have profiles 92 which are accurately shaped so as to match the vertical projection of a particular club head as viewed along the shaft of the irons club. That is to say, for example, a sand wedge iron (S.W.) would just fit within the corresponding profile 92 marked (S.W.). Likewise, the head of a 7 iron would just fit into the opening labeled "7". These profiles 92 are arranged such that each of the shafts shown typically in phantom at 12 are somewhat evenly spaced apart one to another and in close proximity and longitudinally aligned at their outermost portions with the inner periphery 84. Each of the irons heads 14 rests atop the bottom section 110 as previously described in FIG. 8 so that the force of gravity maintains the clubs in this outwardly position leaning against the periphery 84.

By this arrangement of accurately configured profiles 92 formed axially through throat plate 82, it is extremely difficult, if not virtually impossible, to place a particular iron into the wrong opening 92. Further, by the sequential arrangement of irons as shown, club identification is facilitated. Throat plate 82 further includes openings 88 and 94 formed therethrough sized to admit the shaft of a putter and an additional iron, respectively.

In this embodiment 2B, a plurality of guide members shown typically at 96 are formed of opposing pairs of generally U-shaped vertically or longitudinally oriented channel members shown typically at 98 and 100. These channel members 98 and 100 extend between the throat plate 82 and the upper surface of the bottom plate 114, each pair generally configured to match the corresponding end portions of each of the openings 90 so as to, in part, mimic each particular profile 92 to which it is connected. As previously described, each of the guide members 98 and 100 serve to receive the heel 18 and the toe 16, respectively, of one particular iron head 14 so as to fully insure that none of the irons club heads either contact one another or adjacent irons clubs shafts either while stored within the golf bag 2B or while being removed or replaced.

The throat plate 82 also includes an opening 86 for receiving the handles of the three woods 6, the opening 86 extending downwardly by tubular member 112 which also extends down to the bottom plate 114 and connected thereto at its lower end 102. Here again, the shafts 12 of the woods 6 are fully protected from being impacted by the heads 14 of the irons 8 and from excessive rattling and movement within the golf bag 2B. Note that the channel members 98 and 100 may be alternately replaced by a tubular structure similar to that of either tube 70 of guide member 58A in FIG. 5 or tubular member 112 of FIG. 10, although the channel member structure 98 and 100 is preferred.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A golf bag for carrying a set of golf clubs including woods, irons and putter, each having a shaft and a head with a toe and a heel, with the heads of said woods and putter positioned upward and the heads of said irons positioned downward, comprising:

said golf bag including a tubular body elongated along a longitudinal axis and defined by an upper portion having a upper end, a lower portion having a lower end and an integral central portion;

a top section capping said upper end and a bottom section closing said lower end, said top section comprising a throat member and a wall member;

said throat member including a throat plate defined by a first periphery and positioned normal to said longitudinal axis with said first periphery connected to said upper end of said upper portion;

said throat plate containing X number of first openings axially therethrough each having particularly sized and shaped somewhat oval periphery which substantially matches a vertical projection of, and thereby to admit only one particular head of said irons, and Y number of second openings axially therethrough sized to admit the shafts of said woods and putter;

a bottom plate defined by a second periphery and positioned generally normal to said longitudinal axis, said lower end of said lower portion of said tubular body being connected to said second periphery;

X number of guide member means each positioned in substantial vertical alignment with one said first opening for defining a guide periphery that mimics at least in part said sized periphery of one of said first openings of said throat plate.

2. A golf bag as set forth in claim 1 wherein:

each said guide member means includes an opposed pair of U-shaped vertically positioned channel members with a top end thereof attached to each end of one of said oval peripheries and a bottom end thereof supported upon said bottom plate, one of said channel members of each opposed pair serving to receive said toe of one of said irons of said set of clubs and the other of said each opposed pair of said channel members serving to receive said heel of one of said irons of said set of clubs.

3. A golf bag as set forth in claim 1 wherein:

each of said guide member means includes an elongated vertically positioned tube with a top end thereof attached to one of said oval peripheries and a bottom end thereof supported upon said bottom plate.

4. A golf bag for carrying a set of golf clubs including woods, irons and putter, each having a shaft and a head with a toe and a heel, with the heads of said woods and putter positioned upward and the heads of said irons positioned downward, comprising:

said golf bag including a tubular body elongated along a longitudinal axis and defined by an upper portion having a upper end, a lower portion having a lower end and an integral central portion;

a top section capping said upper end and a bottom section closing said lower end, said top section comprising a throat member and a wall member;

said throat member including a throat plate defined by a first periphery and positioned generally normal to said longitudinal axis with said first periphery connected to said upper end of said upper portion;

said wall member being arcuate and upswept from said throat plate defined by a bottom portion and an integral top portion, said bottom portion projecting axially from and above said first periphery;

means connected to an inner surface of said wall member for separately supporting each of the woods heads above said throat member;

said throat plate including a plurality of particularly arranged first openings axially therethrough each having a particularly and individually sized somewhat oval periphery shaped to admit said head of only one particular said iron, and a plurality of second openings axially therethrough sized to admit the shafts of said woods and putter whereby each of said irons clubs will fit into only one of said first opening which are arranged in sequential order for ease in irons club identification;

a bottom plate defined by a second periphery and positioned generally normal to said longitudinal axis, said lower end of said lower portion of said tubular body being connected to said second periphery;

tubular guide members equal in number to said plurality of said first openings each defined by a top end and a bottom end, said bottom end being supported upon said bottom plate, each said guide tubular member defining a guide periphery that mimics one said oval periphery of one said first opening of said throat plate, said guide periphery of each said tubular guide members being connected to one of said sized oval peripheries of said first openings.

5. A golf bag for carrying a set of golf clubs including woods, irons and putter, each having a shaft and a head with a toe and a heel, with the heads of said woods and putter positioned upward and the heads of said irons positioned downward, comprising:

said golf bag including a tubular body elongated along a longitudinal axis and defined by an upper portion having a upper end, a lower portion having a lower end and an integral central portion;

a top section capping said upper end and a bottom section closing said lower end;

said top section comprising a throat member;

said throat member including a throat plate defined by a first periphery and positioned across said top section with said first periphery connected to said upper end of said upper portion;

said throat plate including X number of first openings axially therethrough each to admit one of said heads of said irons, and Y number of second openings axially therethrough sized to admit the shafts of said woods and putter;

each of said first openings having a particular size and shape for admitting only one particular irons club head passing downwardly therethrough whereby said first openings being sequentially arranged by irons club numbers, each irons club is easily visually identifiable;

a bottom plate defined by a second periphery and positioned generally normal to said longitudinal axis, said lower end of said lower portion of said tubular body being connected to said second periphery;

X number of guide members each defined by a top end and a bottom end supported at said bottom end and spaced apart upon said bottom plate, each said guide member defining a guide periphery that mimics at least in part said sized peripheries of each of said first openings of said throat plate;

said guide members being structured to each receive and retain a single iron club of said set of clubs with said toe of said iron club resting on said bottom plate and with said heel of said iron club elevated above said bottom plate thereby holding said shaft of said iron club steady against said oval periphery of said first opening through which said shaft extends.

6. A golf bag as set forth in claim 5, wherein:

each of said guide members include an elongated vertically positioned tube with said top end thereof attached to one of said oval peripheries.

7. A golf bag as set forth in claim 5, wherein:

each said guide member includes an opposed pair of U-shaped vertically positioned channel members with a top end thereof attached to each end of one of said oval peripheries and a bottom end thereof supported upon said bottom plate, one of said channel members of each opposed pair serving to receive said toe of one of said irons of said set of clubs and the other of said each opposed pair of said channel members serving to receive said heel of one of said irons of said set of clubs.

* * * * *